US005749234A

United States Patent [19]

Takano

[11] Patent Number: 5,749,234

[45] Date of Patent: May 12, 1998

[54] TRANSPORTABLE STORAGE CABINET

[75] Inventor: Yoshiaki Takano, Ota, Japan

[73] Assignee: Sanyo Electric Co., Ltd., Osaka, Japan

[21] Appl. No.: 739,148

[22] Filed: Oct. 28, 1996

[30] Foreign Application Priority Data

Oct. 27, 1996 [JP] Japan ..... 8-280467

[51] Int. Cl.[6] ..... F25B 49/02

[52] U.S. Cl. ..... 62/125; 62/129; 62/185

[58] Field of Search ..... 62/125, 129, 185, 62/430, 437, 231; 340/309.15, 585, 636; 368/9, 10, 64, 66

[56] References Cited

U.S. PATENT DOCUMENTS

| | | | |
|---|---|---|---|
| 2,635,432 | 4/1953 | Kleist | 62/3 |
| 2,744,388 | 5/1956 | Kleist | 64/4 |
| 4,014,178 | 3/1977 | Kells | 62/125 |
| 4,437,320 | 3/1984 | Eklund | 62/236 |
| 4,502,287 | 3/1985 | Hare et al. | 340/585 |
| 4,637,222 | 1/1987 | Fujiwara et al. | 62/244 |
| 4,787,212 | 11/1988 | Hessey | 62/129 |
| 4,840,037 | 6/1989 | Yamada et al. | 62/185 |
| 4,928,501 | 5/1990 | Negishi | 62/406 |
| 4,951,481 | 8/1990 | Negishi | 62/430 |
| 5,311,745 | 5/1994 | Lockhart et al. | 62/129 |
| 5,487,276 | 1/1996 | Namisniak et al. | 340/585 |

FOREIGN PATENT DOCUMENTS

| | | | |
|---|---|---|---|
| 1318870 | 12/1989 | Japan | F25D 11/00 |
| 1318871 | 12/1989 | Japan | F25D 11/00 |
| 1318873 | 12/1989 | Japan | F25D 11/00 |
| 3230076 | 10/1991 | Japan | F25D 16/00 |
| 4187962 | 7/1992 | Japan | F25D 3/00 |

*Primary Examiner*—William E. Tapolcai
*Attorney, Agent, or Firm*—Darby & Darby

[57] ABSTRACT

It is an object of the present invention to provide a transportable storage cabinet for which the time at which a refrigerant has been frozen can be estimated. According to the present invention, a transportable storage cabinet, which includes a storage chamber wherein goods are stored, a refrigerant for cooling the storage chamber, and a refrigerator for freezing the refrigerant, comprises: power supply detection means for detecting a supply of power to the refrigerator; a timer for measuring elapsed time; and an elapsed time display means for displaying the elapsed time that is obtained by the timer.

9 Claims, 7 Drawing Sheets

TRANSPORTABLE STORAGE CABINET

BACKGROUND OF THE INVENTION

Field of the Invention

The present invention relates to a transportable storage cabinet wherein a stored refrigerant is frozen by a refrigerator before the storage cabinet is transported, so that while being transported, the interior of the cabinet is cooled by the frozen refrigerant.

For a conventional storage compartment that is conveyed by a truck, etc., and that is disclosed, for example, in Japanese Unexamined Publication No. Sho 64-63430 (B60P3/20), a refrigerant is employed for the internal refrigeration of the compartment. The compartment is mounted and fixed in place on a truck, and a refrigerant is frozen by a refrigerator that is driven by the battery of the truck.

Manufacturing costs for such a truck on which a compartment is mounted and fixed are increased, and it is difficult to use the trick for other purposes. Since the refrigerator for the compartment is battery driven, a battery having a large capacity must be mounted on the truck. Since such a battery is heavy, the weight of the stock that can be carried by the truck is reduced and fuel consumption is increased.

Therefore, a transportable storage cabinet has been proposed wherein are provided a refrigerant and a refrigerator that freezes the refrigerant.

At a distribution center, etc., the refrigerator of the transportable storage cabinet is driven by power supplied by means of a power cord and freezes the refrigerant that is used to absorb heat. When the refrigerant has been frozen and heat absorption is completed, goods such as perishables are stored in the transportable storage cabinet. The power cord is then disconnected from the storage cabinet, and the cabinet is loaded on a truck.

While the transportable storage cabinet, which is being transported by a truck, is internally cooled by the latent heat of melting, the stored goods are delivered. When all the deliveries have been completed and the truck has returned to the distribution center, the transportable storage cabinet is unloaded and its refrigerator is connected to a power cord. When the power cord is connected, the refrigerator is activated again and begins to freeze the refrigerant for the next delivery.

The period that is required for the refrigerator to freeze the refrigerant is normally quite long, and almost equals the period during which the storage cabinet is cooled by the refrigerant, i.e., the period during which the cabinet is transported by a truck. Since the transportation industry generally prepares a 24-hour route schedule that is based on shift work, the person who powers on the transportable storage cabinet after it has been used is not the same person who uses the storage cabinet next.

In addition, a supply of power to the transportable storage cabinet may be forgotten, or may be delayed for some reason, such as heavy traffic. And the person who next uses the transportable storage cabinet will not know what time the cabinet was powered on, and can not estimate when the freezing of the refrigerant will be completed.

SUMMARY OF THE INVENTION

To resolve the above the shortcomings, it is an object of the present invention to provide a transportable storage cabinet for which the time at which a refrigerant has been frozen can be estimated.

A transportable storage cabinet according to the present invention comprises: a storage chamber wherein goods are stored; a refrigerant for cooling the storage chamber; and a refrigerator for freezing the refrigerant.

To achieve the above object, the transportable storage cabinet comprises: power supply detection means for detecting a supply of power to the refrigerator; a timer for measuring elapsed time; and an elapsed time display means for displaying the elapsed time that is obtained by the timer. The timer is activated by a signal output by the power supply detection means and measures the elapsed time.

Further, to achieve the object of the present invention, a transportable storage cabinet comprises temperature detection means for acquiring a temperature reading for a refrigerant; and refrigerant temperature display means for displaying the temperature reading for the refrigerant that is acquired by the temperature detection means before the refrigerant is frozen.

In addition, to achieve the object of the present invention, a transportable storage cabinet comprises: power supply detection means for detecting a supply of power to a refrigerator; temperature detection means for acquiring a temperature reading for a refrigerant; determination means for determining whether or not a condition where the temperature reading for the refrigerant that is acquired by the temperature detection means is equal to or lower than a substantial freezing point and a condition where the power supply detection means detects power is being supplied are satisfied, and, when the conditions are satisfied, for outputting a signal to a timer; a timer, to be activated by a signal output by the determination means, for measuring elapsed time following powering on and initiation of freezing of the refrigerant; and time display means for displaying the elapsed time that is measured by the timer.

DETAILED DESCRIPTION OF THE PREFERRED EMBODIMENT

Figure 1:
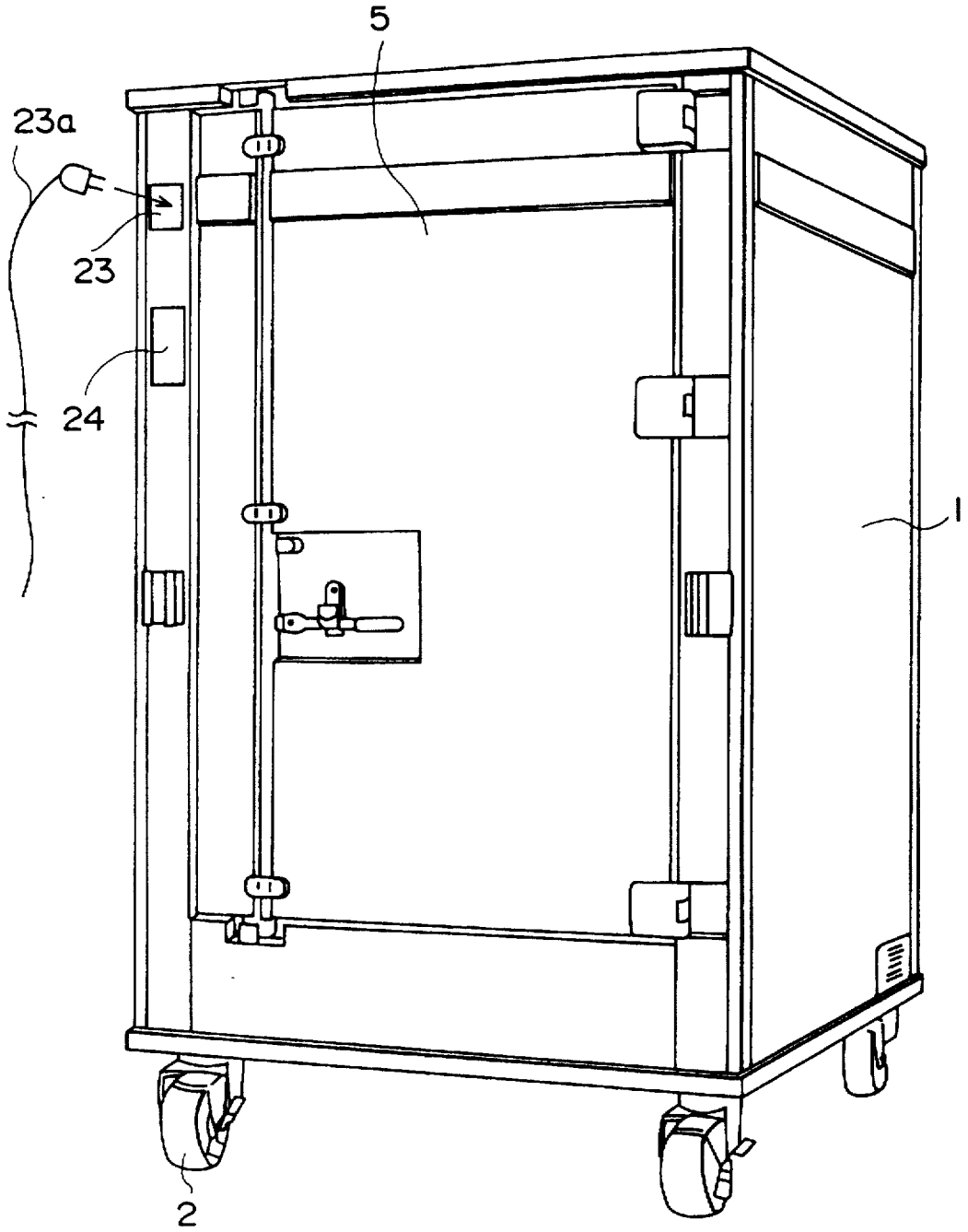
FIG. 1 is a perspective view of a transportable storage cabinet according to the present invention.
Figure 2:
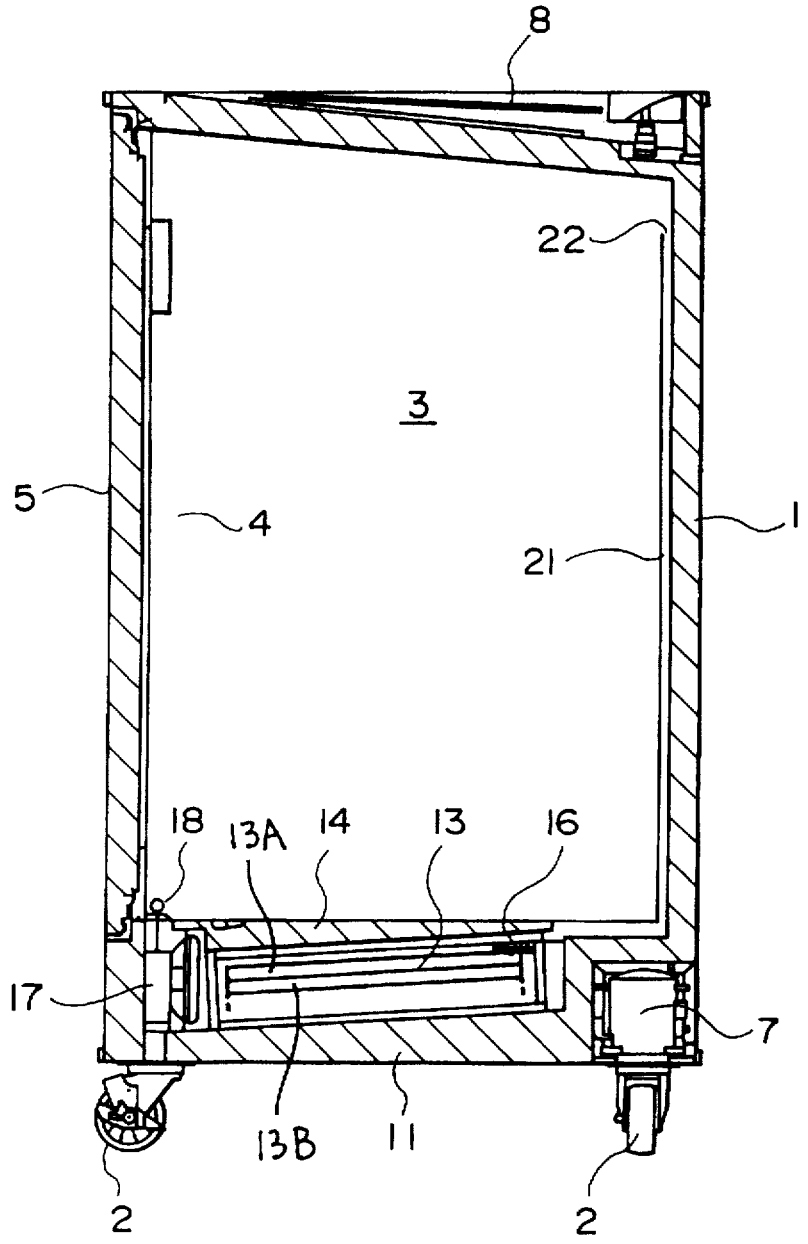
FIG. 2 is a cross-sectional view of the transportable storage cabinet shown in FIG. 1.
Figure 3:
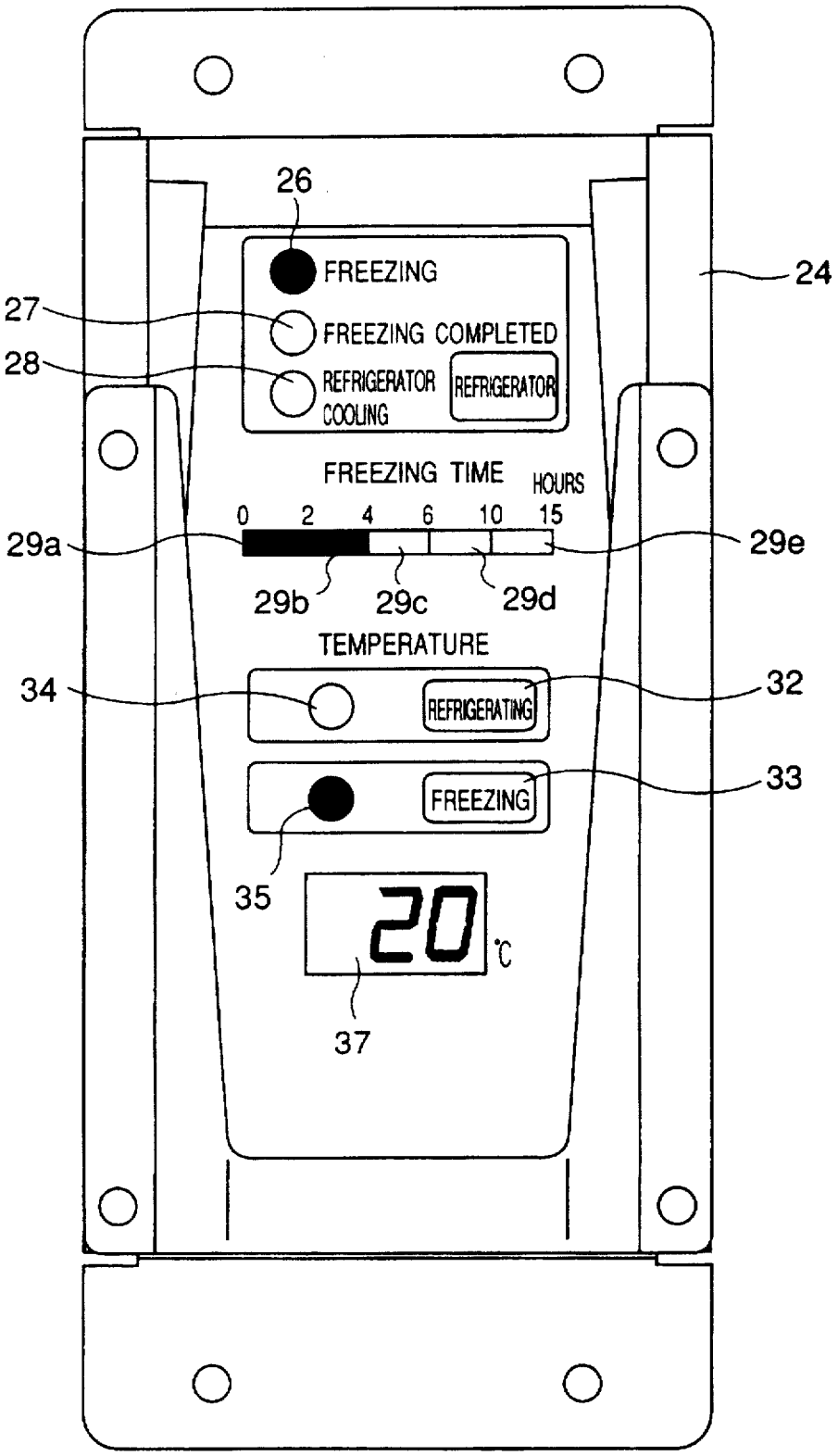
FIG. 3 is a front view of a console panel.
Figure 4:
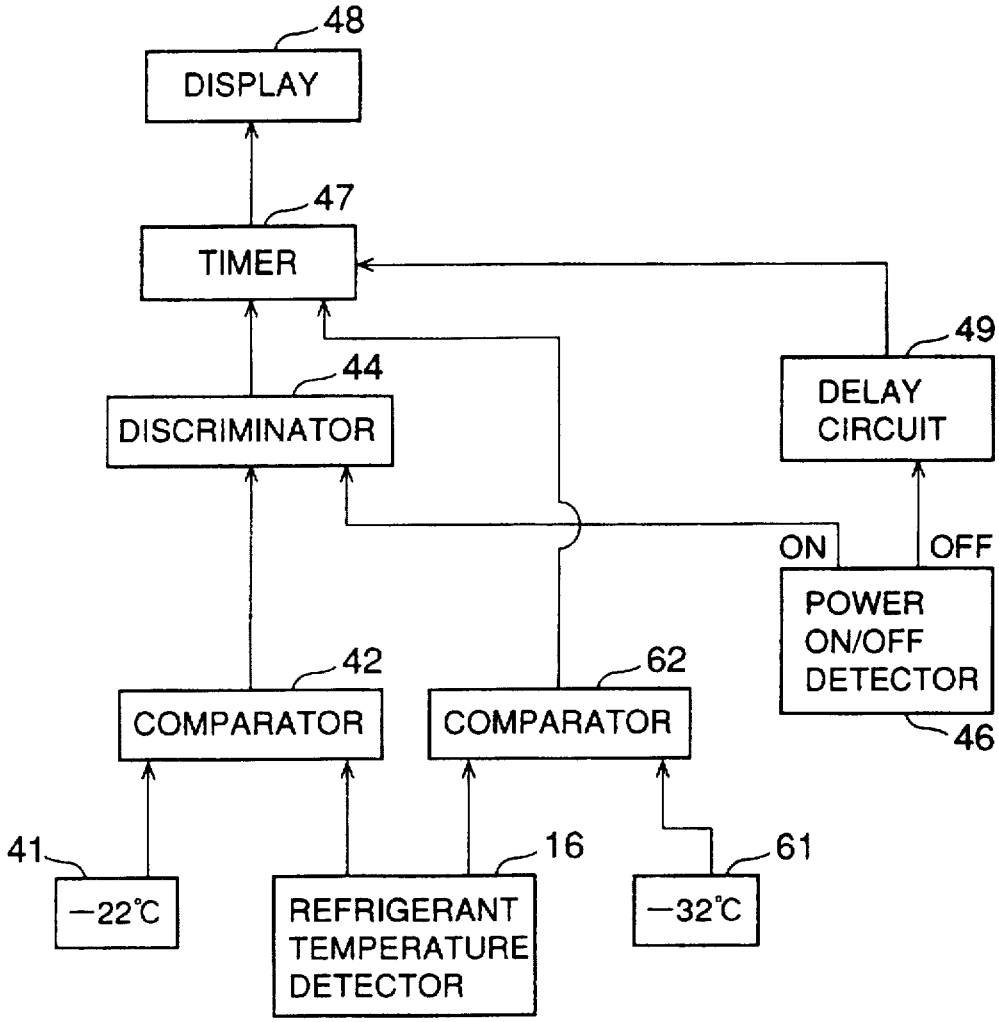
FIG. 4 is a diagram illustrating a control circuit in a display device.
Figure 5:
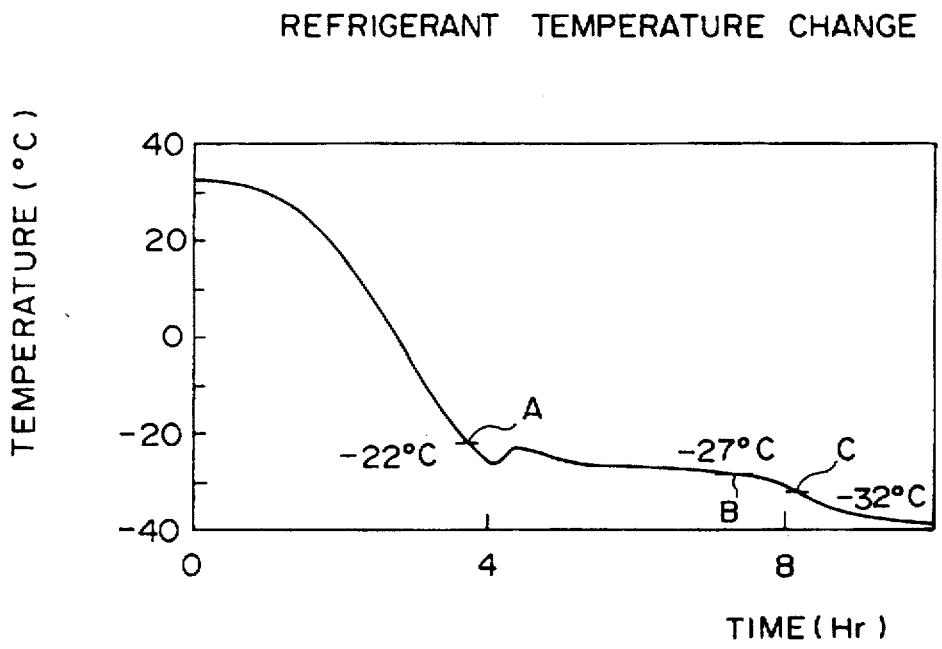
FIG. 5 is a graph showing a temperature change for a refrigerant.

A transportable storage cabinet according to a first embodiment of the present invention will now be described while referring to FIGS. 1 through 5. FIG. 1 is a perspective view of a transportable storage cabinet according to the present invention. FIG. 2 is a cross-sectional view of the transportable storage cabinet shown in FIG. 1. FIG. 3 is a front view of a console panel. FIG. 4 is a diagram illustrating a control circuit for a display device. FIG. 5 is a graph showing a temperature change for a refrigerant.

Casters 2 are attached to the lower portion of an insulated case 1 of a transportable storage cabinet. As the transportable storage cabinet is pulled or pushed, the wheels of the casters 2 rotate to facilitate the moving of the storage cabinet. Inside the insulated case 1 is a storage chamber 3. An opening 4 is formed in the front of the insulated case 1 through which goods can be loaded in, or removed from, the storage chamber 3. The opening 4 is closed by an insulated front door 5, which can be freely opened and closed.

A compressor 7 is located in the rear lower portion of the insulated case 1, and a condenser 8 is located in its upper portion. Over a bottom 11 of the insulated case 1 is located an assembly 13 wherein an evaporator 13B and a refrigerant 13A are alternately laminated. A floor board 14 of the storage chamber covers over the assembly 13.

A refrigerant temperature detector 16 for acquiring the temperature reading for a refrigerant is provided inside the assembly 13. The evaporator 13B in the assembly 13, the compressor 7 and the condenser 8 together constitute a refrigeration circuit, i.e., a refrigerator. When the refrigerator is operated, the evaporator 13B of the assembly 13 reduces the temperature of and refrigerates the refrigerant 13A.

A fan 17 is located in front of the assembly 13. As the fan 17 rotates, it draws air down from the storage chamber 3 through a front intake port 18 in the floor board 14, and feeds the air to the assembly 13. The air is cooled by the refrigerant 13A in the assembly 13. The cooled air is then discharged from the rear of the assembly 13, passes through a cool air circulation duct 21 that is provided along the rear portion of the storage chamber 3, and is ejected into the storage chamber 3 through an ejection port 22 in the cool air circulation duct 21. In this manner, the air in the storage cabinet is circulated by the fan 17 and is cooled by the refrigerant 13A in the assembly 13.

A power receptacle 23 and a console panel 24 are located on the left front of the insulated case 1. As is shown in FIG. 3, in the upper portion of the console panel 4 are provided a freezing lamp 26 for signaling when the refrigerant 13A in the assembly 13 is being frozen by the evaporator, a freezing completion lamp 27 for signaling when the freezing of the refrigerant 13A has been completed; and an interior cooling lamp 28 for signaling when the cabinet is being cooled.

Although the freezing lamp 26 is used to indicate "freezing," actually, since it is turned on while the refrigerant 13A is being evaporated and heat is being absorbed, so that the refrigerant 13A may not yet be frozen or it may be frozen. Similarly, although the freezing completion lamp 27 is used to indicate "freezing completed," actually it is turned on when heat absorption by the refrigerant 13A is completed. Since at this time the refrigerant 13A is frozen, the time when the temperature of the frozen refrigerant 13A is further reduced is determined as the time when heat absorption is completed.

As is described above, the "freezing" and "freezing completed" displays do not strictly represent the state of the refrigerant 13A, but are general terms that are employed to easily express when heat is being absorbed and when the absorption of heat has been completed.

LED freezing period lamps **29*a* through 29*e* are provided below the lamps 26, 27 and 28. Below the freezing period lamps 29*a* through 29*e* are provided select buttons 32 and 33, which are used for selecting an internal temperature for the storage cabinet, which is either a refrigerating temperature or a freezing temperature, and selection display lamps 34 and 35. Below these is located an interior temperature display 37** for displaying the internal temperature of the storage cabinet.

When the transportable storage cabinet is in a distribution center, etc., power is supplied to it by connecting a power cord **23*a* to the power receptacle 23. The refrigerator is activated by the power and reduces the temperature of the evaporator in the assembly 13. The evaporator 13B then refrigerates the refrigerant 13A. The temperature reading for the refrigerant 13A that is acquired by the refrigerant temperature detector 16 is therefore reduced, as is shown in FIG. 5**.

When the temperature of the refrigerant 13A is reduced until it reaches point A (a temperature that is little higher temperature than the freezing point) in FIG. 5, i.e., about −22° C., the freezing of the refrigerant 13A is begun and the latent heat change is begun. During the change in the latent heat, the temperature of the refrigerant 13A is only gradually reduced, and is not altered for an extended time of period. At point B in FIG. 5, whereat the temperature of the refrigerant 13A is about −27° C., the refrigerant 13A is substantially frozen and the change in the latent heat is ended.

When the change in the latent heat has ended, the temperature of the refrigerant 13A is again reduced. When the refrigerant temperature detector 16 ascertains that the temperature of the refrigerant 13A has reached point C in FIG. 5, i.e., about −32° C., a refrigerator controller assumes that heat absorption by the refrigerant 13A has been completed, and turns on the freezing completion lamp 27 and halts the refrigerator. As is described above, the freezing completion lamp 27 is turned on after the refrigerant 13A is completely frozen.

The freezing period lamps **29*a* through 29*e* are controlled by a controller shown in FIG. 4. In FIG. 4, a temperature for the refrigerant 13A at which a timer is activated is set in a temperature setting section. In this case, the temperature at point A (a little higher than the freezing point), i.e., about −22° C., is set in the temperature setting section 41. A comparator 42 compares the temperature that is set in the temperature setting section 41 with the temperature reading for the refrigerant 13A that is acquired by the refrigerant temperature detector 16. When the temperature of the refrigerant 13A is lower than the set temperature, the comparator 42 outputs a start signal to a discriminator 44**.

A power supply detector 46 is constituted by a relay. As is shown in FIG. 1, the power supply detector 46 detects when power is on by the connection of the power cord **23*a* to the power receptacle 23. When power is on, the power supply detector 46 outputs a start signal to the discriminator 44. The discriminator 44, which is constituted by an AND circuit, receives start signals from both the comparator 42 and the power supply detector 46, and generates a start signal for a timer 47**.

When the discriminator 44 receives only one start signal, either from the comparator 42 or the power supply detector 46, it does not generate a start signal. Upon receipt of a start signal, the timer 47 measures the time that elapses after the refrigerant 13A has begun to freeze. The time that has elapsed is displayed on a display 48, and one of the freezing period lamps **29*a* through 29*e* that corresponds to the elapsed time is turned on When the power cord 23*a* is removed from the power receptacle 23 and the supply of power is halted, the power supply detector 46 senses that the supply of power is halted, and outputs a signal to a delay circuit 49. After a delay of about five minutes, the delay circuit 49 outputs the received signal to the timer 47 and resets the timer 47. When during the delay period for the delay circuit 49 power is again supplied, the delay circuit 49 does not output a reset signal to the timer 47**.

In this manner, when the freezing of the refrigerant 13A is begun, the freezing period lamps **29*a* through 29*e* are sequentially turned on to indicate the time that has elapsed. A comparator 62 compares the output of the refrigerant temperature detector 16 with the output of the temperature setting section 61. When the temperature reading acquired by the refrigerant temperature detector 16 is lower than −32° C. that is set in the temperature setting section 61, the comparator 62 outputs a stop signal to the timer 47**.

Upon receipt of the stop signal, the timer 47 halts the measurement of elapsed time, and holds the count for the time that elapsed up until absorption of heat is completed following the beginning of the freezing of the refrigerant 13A. A display 48 continues to display the time count that is held. As was previously described, the freezing completion lamp 27 is turned on, and the freezing lamp 26 is turned off.

When the freezing completion lamp 27 is turned on, the fan 17 is driven to cool the storage chamber 3. During the operation of the fan 17, the interior cooling lamp 28 is kept on. Goods are stored in the storage chamber 3 that is maintained cool in the above described manner, the power cord **23*a* is disconnected form the power receptacle 23, and the transportable storage cabinet is loaded on a truck for transportation. When the power cord 23*a* is disconnected from the storage cabinet, the fan 17 and the lamps are powered by a battery that is incorporated in the transportable storage cabinet. When the goods have been delivered and the truck has returned to the distribution center, the transportable storage cabinet is unloaded from the truck, and the power cord 23*a* is again connected to the power receptacle 23** to supply power to the storage cabinet.

As was described above, by turning on the freezing period lamps **29*a* through 29*e*, it is possible to indicate a power conductive period beginning at a point whereat the temperature is near the freezing start temperature for the refrigerant 13A, i.e., a power conductive period beginning at point A. Therefore, the approximate time at which the freezing completion lamp 27** will be turned on can be estimated.

Under normal operating conditions, the truck returns to the distribution center during a period wherein the temperature of the refrigerant 13A lies within a range extending from point A to point B. Thus, when the supply of power is begun, the timer 47 begins to measure the time (an operating condition corresponding to claim 1). Under normal operating conditions, the period that extends from the time the supply of power is begun until the freezing completion lamp 27 is turned on is unknown.

However, since route schedules for trucks are generally made in advance, the period extending up until heat absorption by the refrigerant 13A is completed does not change very much for daily operations, although the period varies depending on the seasons. As a result, the time at which the freezing completion lamp 27 is turned on can be estimated from past experience. The periods indicated by the freezing period lamps **29*a* though 29*e*** do not exceed a period that is represented by the distance between point A and C, i.e., about five hours.

Since the delay circuit 49 is provided, the timer 47 will not immediately be reset even when the power cord **23*a* is erroneously removed from the power receptacle 23 while power is being supplied. So long as the power cord 23*a* is reconnected to the power receptacle 23 within the period for a delay, the timer 47 can resume measuring the time that elapses. Therefore, a large measured time error, which is caused by the erroneous disconnection of the power cord 23*a* from the power receptacle 23**, will not occur.

In the first embodiment of the present invention, the comparator 42, the discriminator 44, the temperature setting section 41 and the refrigerant temperature detector 16 are provided to begin measuring the time that elapses after point A is reached. These components can be eliminated, and the timer 47 can be activated at the same time as the output of the power supply detector 46 is begun.

Figure 6:
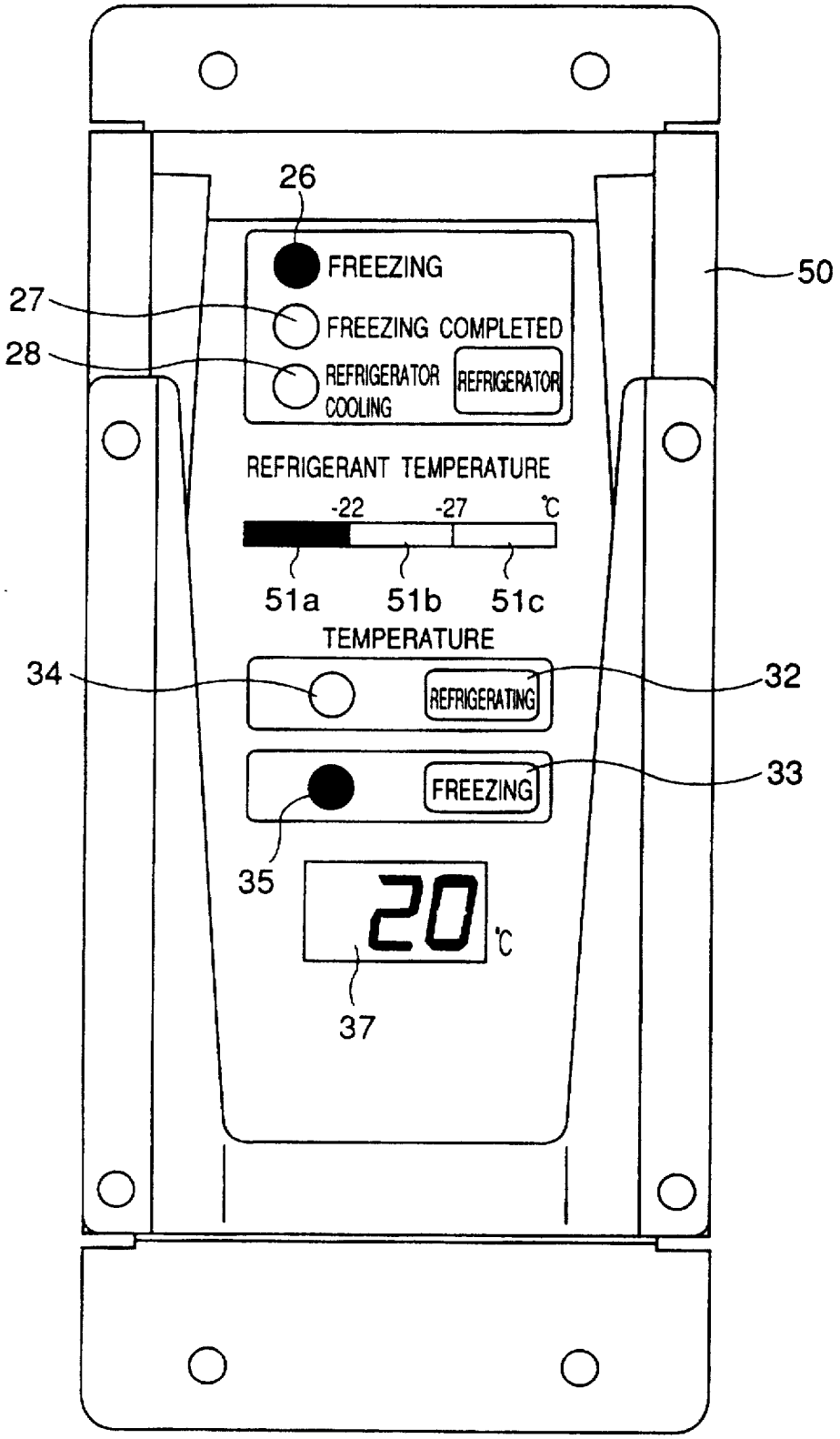
FIG. 6 is a front view of another console panel.
Figure 7:
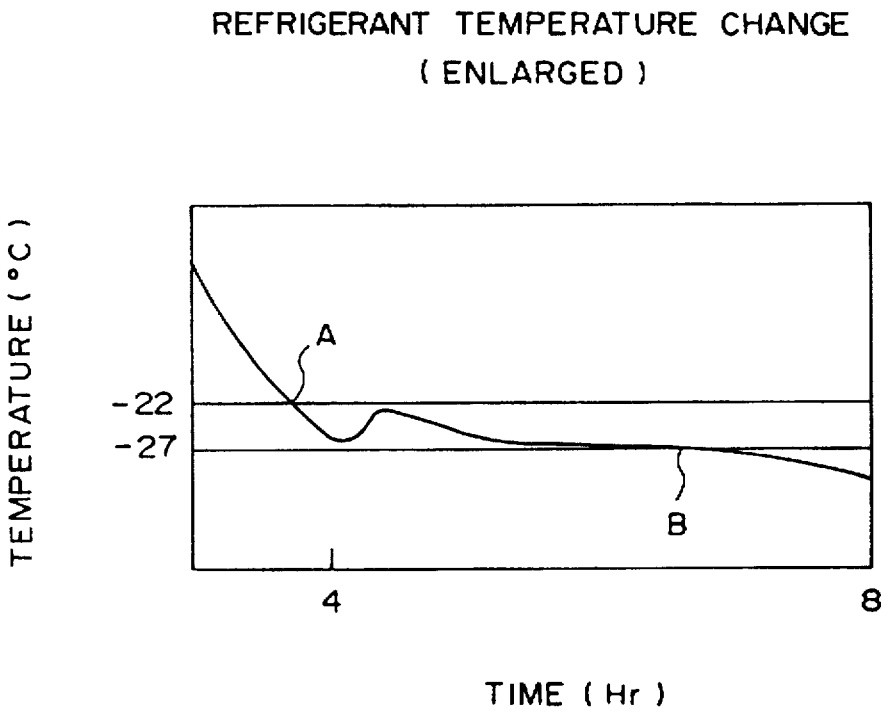
FIG. 7 is an enlarged diagram illustrating the essential portion in FIG. 5.

A transportable storage cabinet according to a second embodiment of the present invention will now be described while referring to FIGS. 6 and 7. FIG. 6 is a front view of a console panel. FIG. 7 is an enlarged diagram illustrating the essential portion in FIG. 5. The same reference numerals as are used in the first embodiment are also used for the second embodiment and denote corresponding or identical components, for which no detailed explanation will be given.

According to the second embodiment, the console panel 24 in the first embodiment is replaced with a console panel 50 shown in FIG. 6. The console panel 50 is almost the same as the console panel 24, except that the freezing period lamps **29*a* through 29*e* are replaced by refrigerant temperature lamps 51*a*, 51*b* and 51*c*, which indicate the temperature of a refrigerant 13A. Using the refrigerant temperature lamps 51, 51*b* and 51*c*, the temperature of the refrigerant 13A** before heat is absorbed is displayed at a plurality of steps.

The leftmost refrigerant temperature lamp **51*a* is turned on when the temperature acquired by the refrigerant temperature detector 16 is equal to or higher than −22° C. The refrigerant temperature lamp 51*b* in the center is turned on when the temperature reading acquired by the refrigerant temperature detector 16 is between approximately −22° C. and −27° C. The rightmost refrigerant temperature lamp 51*c* is turned on when the temperature reading acquired by the refrigerant temperature detector 16** is equal to or lower than −27° C.

Therefore, when the leftmost refrigerant temperature lamp **51*a* is on, it is apparent that the temperature of the refrigerant 13A has not reached point A shown in FIG. 7, and considerable time is required before the heat absorption is completed. When the refrigerant temperature lamp 51*b* in the center is turned on, it is apparent that part of the refrigerant 13A is frozen and that part is not frozen, and that latent heat is being changed, so that time is still required before the heat absorption is completed. When the rightmost refrigerant temperature lamp 51*c* is turned on, it is apparent that the refrigerant 13A is almost frozen, and a freezing completion lamp 27** will be turned on in a short time.

As is described above, in the second embodiment, by turning on the refrigerant temperature lamp **51*a*, 51*b* or 51*c*, the condition where most of the refrigerant 13A is not yet frozen, the condition where the refrigerant 13A is partially frozen and partially unfrozen, i.e., the condition where latent heat is being changed, or the condition where the refrigerant 13A is almost frozen can be identified. Therefore, the time at which the heat absorption by the refrigerant 13A is completed, i.e., the time at which the freezing completion lamp 27** is turned on, can be estimated.

Although the preferred embodiments of the present invention have been described in detail, the present invention is not limited to the embodiments, and various modifications are possible that fall within the scope of the present invention as cited in the claims. Modifications of the present invention will be explained.

(1) Various time period display means can be used, so long as they can display the time that has elapsed. For example, a specific period, such as one hour and twenty minutes, may be displayed, or a plurality of lamps may be sequentially turned on as the time elapses. Similarly, various types of display means can be selected for use as the refrigerant temperature display, so long as the temperature of the refrigerant is displayed. A specific temperature, e.g., −24° C., may be displayed, or a lamp may be turned on in consonance with an acquired temperature reading.

(2) Although the delay circuit is employed in the above embodiments, it need not necessarily be provided. Further, although the delay time given is five minutes, it can be changed as needed.

(3) The power supply detection means may only sense, for example, the starting of the operation of the refrigerator. The timer may measure the time that elapses after the refrigerator has begun to operate, besides controlling the ON and OFF states of the refrigerator, as is described in the above embodiments.

As is described, according to the present invention, when power is supplied to the refrigerator for freezing the refrigerant, the timer is activated and measures the elapsed time, and the display means displays the measured time count. Since the refrigeration period for the refrigerant is shown, an approximate period extending up until the heat absorption by the refrigerant is completed can be estimated. As a result, it is not necessary for a person to stand in front of the transportable storage cabinet for a long time and wait for the heat absorption of the refrigerant to be completed.

In addition, according to the present invention, the temperature detection means acquires the temperature reading for the refrigerant, and the refrigerant temperature display means displays the temperature reading for the refrigerant before heat absorption is completed. Since the temperature of the refrigerant before heat absorption is completed is known, whether the refrigerant is not yet frozen, is in the condition where there is a change in the latent heat, or is mostly frozen can be ascertained. By referring to the state of the refrigerant, the time period before heat absorption by the refrigerant will be completed can be estimated.

Further, even when the transportable storage cabinet is not continuously in use and the temperature of the refrigerant thus almost equals the external temperature, once power is supplied, the timer measures the time since the freezing of the refrigerant was begun, i.e., the time that has elapsed since the temperature of the refrigerant reached the freezing temperature. The time that is required for the refrigerant to absorb heat can be estimated almost without taking into account the external temperature.

What is claimed is:

1. A transportable storage cabinet, which includes a storage chamber wherein goods are stored, a refrigerant for cooling said storage chamber, and a refrigerator for freezing said refrigerant, comprising:

power supply detection means for detecting a supply of power to said refrigerator;

a timer, to be activated by a signal output by said power supply detection means, for measuring elapsed time; and an elapsed time display means for displaying said elapsed time that is obtained by said timer.

2. A transportable storage unit as in claim 1 further comprising:

temperature detection means for acquiring a temperature reading for a refrigerant; and refrigerant temperature display means for displaying said temperature reading for said refrigerant that is acquired by said temperature detection means before said refrigerant is frozen.

3. A transportable storage unit as in claim 1 further comprising:

temperature detection means for acquiring a temperature reading for a refrigerant;

refrigerant temperature display means for displaying said temperature reading for said refrigerant that is acquired by said temperature detection means before said refrigerant is frozen; and determination means for determining whether or not a condition where said temperature reading for said refrigerant that is acquired by said temperature detection means is equal to or lower than a substantial freezing point and a condition where said power supply detection means detects power conditions being supplied are satisfied, and when said conditions are satisfied, for outputting a signal.

4. A transportable storage unit as in claim 3 further comprising:

a timer, to be activated by a signal output by said determination means, for measuring elapsed time following powering on and initiation of freezing of said refrigerant; and time display means for displaying said elapsed time that is measured by said timer.

5. A transportable storage unit as in claim 1 further comprising:

determination means for determining whether or not a condition where said temperature reading for said refrigerant that is acquired by said temperature detection means is equal to or lower than a substantial freezing point and a condition where said power supply detection means detects power conditions being supplied are satisfied, and, when said conditions are satisfied, for outputting a signal;

a timer, to be activated by a signal output by said determination means, for measuring elapsed time following powering on and initiation of freezing of said refrigerant; and time display means for displaying said elapsed time that is measured by said timer.

6. A transportable storage cabinet, which includes a storage chamber wherein goods are stored, a refrigerant for cooling said storage chamber, and a refrigerator for freezing said refrigerant, comprising:

temperature detection means for acquiring a temperature reading for a refrigerant; and refrigerant temperature display means for displaying said temperature reading for said refrigerant that is acquired by said temperature detection means before said refrigerant is frozen.

7. A transportable storage cabinet, which includes a storage chamber wherein goods are stored, a refrigerant for cooling said storage chamber, and a refrigerator for freezing said refrigerant, comprising:

power supply detection means for detecting a supply of power to a refrigerator;

temperature detection means for acquiring a temperature reading for a refrigerant;

determination means for determining whether or not a condition where said temperature reading for said refrigerant that is acquired by said temperature detection means is equal to or lower than a substantial freezing point and a condition where said power supply detection means detects power is being supplied are satisfied, and, when said conditions are satisfied, for outputting a signal;

a timer, to be activated by a signal output by said determination means, for measuring elapsed time following powering on and initiation of freezing of said refrigerant; and time display means for displaying said elapsed time that is measured by said timer.

8. A transportable storage unit as in claim 7, further comprising:

refrigerant temperature display means for displaying said temperature reading for said refrigerant that is acquired by said temperature detection means before said refrigerant is frozen.

9. A transportable storage cabinet, which includes a storage chamber wherein goods are stored, a refrigerant for cooling said storage chamber, and a refrigerator for freezing said refrigerant in response to a supply of power, comprising:

temperature detection means for acquiring a temperature reading for said refrigerant;

refrigerant temperature display means for displaying said temperature reading for said refrigerant acquired by said temperature detection means before said refrigerant is frozen;

power supply detection means for detecting a supply of power to said refrigerator;

determination means for determining whether there exists conditions where said temperature reading for said refrigerant that is acquired by said temperature detection means is equal to or lower than a substantial freezing point, and said power supply detection means detects power being supplied to said refrigerator, and when said conditions exist, creating an output signal;

a timer, to be activated by said output signal from said determination means, for measuring elapsed time following powering on and initiation of freezing of said refrigerant; and time display means for displaying said elapsed time that is measured by said timer.

* * * * *

UNITED STATES PATENT AND TRADEMARK OFFICE

CERTIFICATE OF CORRECTION

PATENT NO. : 5,749,234

DATED : MAY 12, 1998

INVENTOR(S) : Yoshiaki TAKANO

It is certified that error appears in the above-identified patent and that said Letters Patent is hereby corrected as shown below:

On the title page, item [30],

The Foreign Application Priority Data the date is incorrect. It should be 10/27/95.

Signed and Sealed this

Eighteenth Day of August, 1998

Bruce Lehman

*Attest:*

BRUCE LEHMAN

*Attesting Officer*

*Commissioner of Patents and Trademarks*